US010312597B2

(12) United States Patent
Savage et al.

(10) Patent No.: US 10,312,597 B2
(45) Date of Patent: Jun. 4, 2019

(54) FERRITE-ENHANCED METAMATERIALS

(71) Applicant: The Boeing Company, Chicago, IL (US)

(72) Inventors: Larry Leon Savage, Huntsville, AL (US); John Dalton Williams, Decatur, AL (US); Corey McKinney Thacker, Madison, AL (US); Jarrod Douglas Fortinberry, Somerville, AL (US); Preston Tyler Bushey, Hampton Cove, AL (US)

(73) Assignee: The Boeing Company, Chicago, IL (US)

( * ) Notice: Subject to any disclaimer, the term of this patent is extended or adjusted under 35 U.S.C. 154(b) by 634 days.

(21) Appl. No.: 14/865,600

(22) Filed: Sep. 25, 2015

(65) Prior Publication Data

US 2017/0093045 A1 Mar. 30, 2017

(51) Int. Cl.
*H01Q 15/00* (2006.01)
*H01Q 15/02* (2006.01)

(52) U.S. Cl.
CPC ..... *H01Q 15/0086* (2013.01); *H01Q 15/02* (2013.01)

(58) Field of Classification Search
CPC . H01Q 15/02; H01Q 15/0086; H01Q 15/0006
USPC ..... 343/753, 909
See application file for complete search history.

(56) References Cited

U.S. PATENT DOCUMENTS 7,522,124 B2 * 4/2009 Smith ..... H01Q 15/02 343/873
8,830,556 B2 * 9/2014 Smith ..... B82Y 20/00 250/505.1
9,577,723 B1 2/2017 Jesiolowski et al.
2006/0109540 A1 * 5/2006 Kueks ..... G02F 1/0126 359/321
2008/0192331 A1 * 8/2008 Wang ..... B82Y 20/00 359/315
2010/0277298 A1 11/2010 Lam et al.
2014/0022029 A1 1/2014 Glushchenko et al.
2014/0354479 A1 * 12/2014 Britz ..... H01Q 3/44 342/372
2016/0301376 A1 10/2016 Williams

FOREIGN PATENT DOCUMENTS

EP 1975656 A1 10/2008

OTHER PUBLICATIONS

Extended European Search Report, dated Feb. 24, 2017, regarding Application No. EP16188160.2, 10 pages.

(Continued)

*Primary Examiner* — Dameon E Levi
*Assistant Examiner* — Hasan Islam
(74) *Attorney, Agent, or Firm* — Yee & Associates, P.C.

(57) ABSTRACT

A method and apparatus for tuning a metamaterial cell. A set of electromagnetic properties of a tunable element associated with the metamaterial cell may be tuned. A resonance of the metamaterial cell may be adjusted in response to the set of electromagnetic properties being tuned. A range of frequencies over which the metamaterial cell provides a negative index of refraction may be changed in response to the resonance of the metamaterial cell changing.

24 Claims, 11 Drawing Sheets

(56) References Cited

OTHER PUBLICATIONS

Huang et al., "Tunable dual-band ferrite-based metamaterials with dual negative refractions", Applied Physics A: Materials Science & Processing, Nov. 2011, pp. 79-86.
Zografopoulos et al., "Liquid-crystal tunable fishnet terahertz metamaterials", 2014 Fotonica AEIT Italian Conference on Photonics Technologies, May 2014, 4 pages.
Williams, "Tunable Bandpass Filter for Communication System," U.S. Appl. No. 14/685,579, filed Apr. 13, 2015, 27 pages.
Jesiolowski et al., "Systems and Methods of Analog Beamforming for Direct Radiating Phased Array Antennas," U.S. Appl. No. 14/821,980, 24 pages.
Kowerdziej et al., "Tunable negative index metamaterial employing in-plane switching mode at terahertz frequencies," Liquid Crystals, vol. 39, No. 7, Jul. 2012, pp. 827-831.
European Patent Office Examination Report, dated Jun. 4, 2018, regarding Application No. EP16188160.2, 9 pages.

* cited by examiner

FERRITE-ENHANCED METAMATERIALS

BACKGROUND INFORMATION

1. Field

The present disclosure relates generally to metamaterials. More particularly, the present disclosure relates to a method and apparatus for adjusting a resonance of a metamaterial structure using a tunable element associated with the metamaterial structure.

2. Background

A metamaterial may be an artificial composite material engineered to have properties that may not be currently found in nature. A metamaterial structure may be an assembly of multiple individual metamaterial cells that are formed from conventional materials. These conventional materials may include, but are not limited to, metals, metal alloys, plastic materials, and other types of materials.

The refractive index for a metamaterial cell is determined by the electric permittivity and magnetic permeability of the metamaterial cell. The refractive index determines how an electromagnetic wave propagating through the metamaterial cell is bent, or refracted. A negative index metamaterial (NIM) is a metamaterial that provides a negative index of refraction over a particular frequency range that is typically determined by the resonance of the metamaterial. This frequency range is typically a band of frequencies centered at or near a resonant frequency of the metamaterial. The frequency range over which the negative index of refraction is provided by a metamaterial structure may be dependent on various factors including the orientation, size, shape, and pattern of arrangement of the metamaterial cells that form the metamaterial structure.

A metamaterial structure may take the form of a two-dimensional or three-dimensional periodic structure of self-resonant metamaterial cells that are each typically self-resonant within the same frequency range, which may be a limited or narrow frequency range. The aggregate effect provided by this type of metamaterial structure may be used to focus electromagnetic energy in a manner similar to an optical lens.

While the negative index of refraction effects of metamaterial structures provide a powerful means of directing electromagnetic energy, these metamaterial structures have a limited operational frequency range. Increasing the range of frequencies over which a negative index of refraction may be provided by a particular metamaterial structure may be useful in certain applications. Therefore, it would be desirable to have a method and apparatus that take into account at least some of the issues discussed above, as well as other possible issues.

SUMMARY

In one illustrative embodiment, an apparatus comprises a metamaterial cell and a tunable element associated with the metamaterial cell. The metamaterial cell has a negative index of refraction. Tuning a set of electromagnetic properties of the tunable element adjusts a resonance of the metamaterial cell.

In another illustrative embodiment, a metamaterial structure comprises a plurality of meta-units. A meta-unit in the plurality of meta-units comprises a metamaterial cell and a tunable element associated with the metamaterial cell. Tuning at least one of an electric permittivity or a magnetic permeability of the tunable element adjusts a resonance of the metamaterial cell. Further, adjusting the resonance for at least a portion of the plurality of meta-units adjusts a frequency range over which the metamaterial structure provides a negative index of refraction for focusing electromagnetic energy.

In yet another illustrative embodiment, a method is provided for tuning a metamaterial cell. A set of electromagnetic properties of a tunable element associated with the metamaterial cell may be tuned. A resonance of the metamaterial cell may be adjusted in response to the set of electromagnetic properties being tuned. A range of frequencies over which the metamaterial cell provides a negative index of refraction may be changed in response to the resonance of the metamaterial cell changing.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account different considerations. For example, the illustrative embodiments recognize and take into account that it may be desirable to have a method and apparatus that enable adaptive tuning of the resonance of metamaterial cells for the purposes of varying the range of frequencies over which the metamaterial cell provides a negative index of refraction, for enabling the directing of electromagnetic energy in a desired direction.

The illustrative embodiments recognize and take into account that it may be desirable to tune the resonance of a metamaterial cell to thereby adjust the frequency range over which a metamaterial cell provides a negative index of refraction. In particular, it may be desirable to have a method and apparatus for performing this tuning without having to change the physical structure or geometric configuration of the metamaterial cell.

Thus, the illustrative embodiments provide a method and apparatus for controlling a metamaterial cell. In one illustrative example, a tunable element is associated with a metamaterial cell having a negative index of refraction. A set of electromagnetic properties of a tunable element may be tuned to adjust a resonance of the metamaterial cell. A direction in which electromagnetic energy passing through the metamaterial cell is focused is controlled based on the tuning of the set of electromagnetic properties of the tunable element. The set of electromagnetic properties of the tunable element may include, for example, an electric permittivity, a magnetic permeability, or both.

A plurality of metamaterial cells that form a metamaterial structure may be tuned as described above to provide an aggregate negative refractive index effect that enables electromagnetic energy to be focused in a desired direction. The direction in which the electromagnetic energy is focused may be easily changed by adjusting the resonance of one or more metamaterial cells of the plurality of metamaterial cells.

In the different illustrative examples, the base terms of "adjust," "change," and "tune," and the various derivatives of these base terms may be used interchangeably. In other words, tuning a resonance may mean the same as adjusting the resonance or changing the resonance. Similarly, tuning an electromagnetic property may mean the same as changing or adjusting that electromagnetic property.

Figure 1:
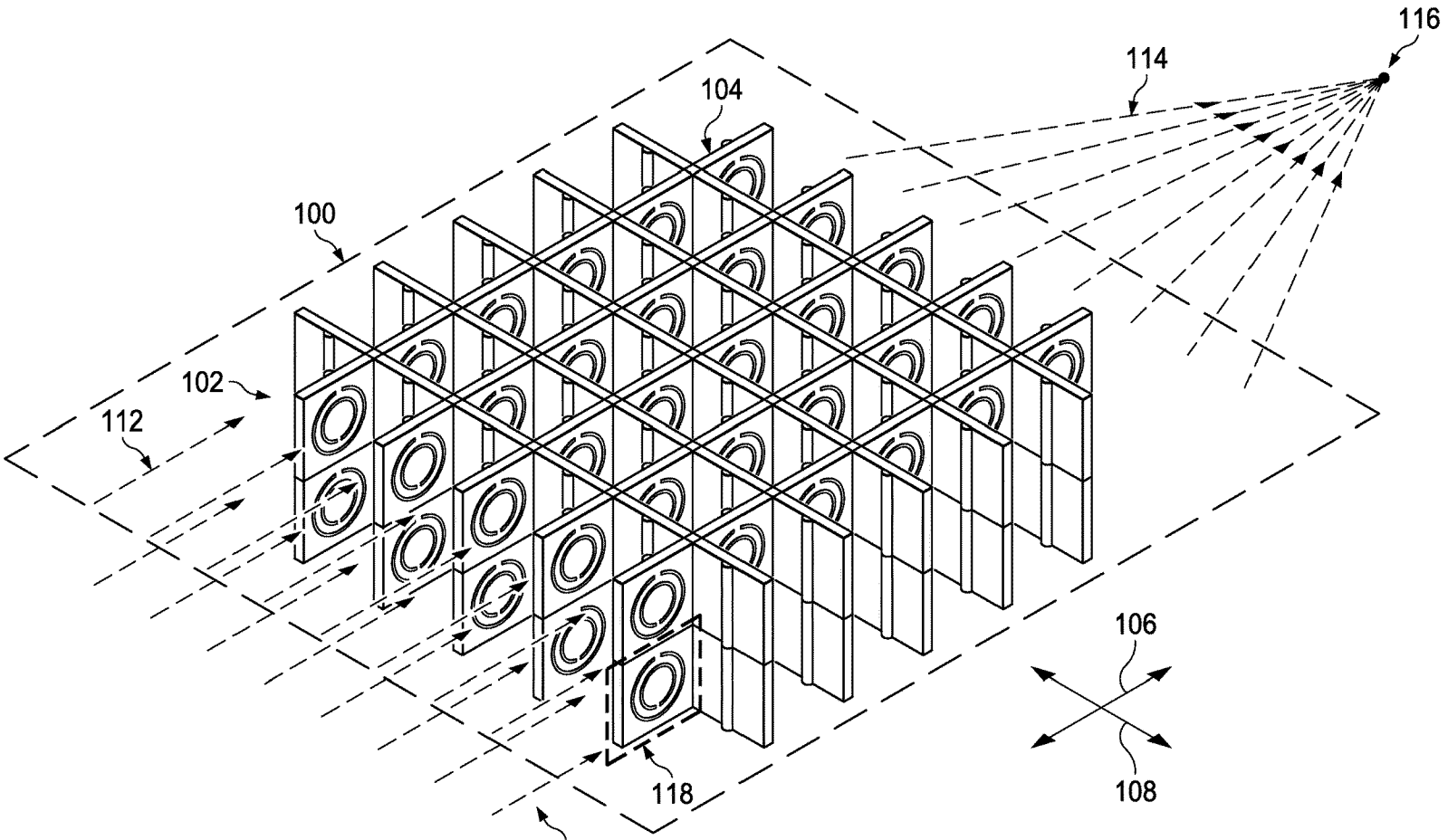
FIG. 1 is an illustration of an isometric view of an energy directing system in accordance with an illustrative embodiment.

Referring now to the figures and, in particular, with reference to FIG. 1, an illustration of an isometric view of an energy directing system is depicted in accordance with an illustrative embodiment. In this illustrative example, energy directing system 100 may be used to direct and focus electromagnetic energy.

As depicted, energy directing system 100 includes metamaterial structure 102. Metamaterial structure 102 is comprised of plurality of meta-units 104. In this illustrative example, plurality of meta-units 104 may be arranged to form a grid. For example, without limitation, a first portion of plurality of meta-units 104 is arranged substantially parallel to first axis 106 and may be configured to receive electromagnetic energy that propagates in a direction substantially parallel to axis 106. A second portion of plurality of meta-units 104 is arranged substantially parallel to second axis 108 and may be configured to receive electromagnetic energy that propagates in a direction substantially parallel to axis 108. In this illustrative example, second axis 108 and first axis 106 are perpendicular to each other.

Metamaterial structure 102 may be used to direct and focus electromagnetic energy 110. In particular, metamaterial structure 102 may be used to control propagation path 112 of electromagnetic energy 110 that passes through metamaterial structure 102. For example, metamaterial structure 102 may be used to focus electromagnetic energy 110 in a desired direction. In other words, metamaterial structure 102 may be used to form focused electromagnetic energy 114 that is directed towards a particular point 116 in space.

Energy directing system 100 may operate in a reflection mode, a transmission mode, or both. In the transmission mode, electromagnetic energy 110 passes through metamaterial structure 102 and may be focused by metamaterial structure 102 towards the particular point 116 in a manner similar to a transmission lens effect. Metamaterial structure 102 is configured to allow electromagnetic energy 110 to pass through metamaterial structure 102 with reduced loss.

In the reflection mode, metamaterial structure 102 is used to reflect electromagnetic energy 110 in a particular direction and may focus a beam of electromagnetic energy 110 towards a particular point in space in a manner similar to a reflection lens effect. Metamaterial structure 102 is configured to prevent the passage of electromagnetic energy 110 through metamaterial structure 102.

In one illustrative example, metamaterial structure 102 includes plurality of meta-units 104. Meta-unit 118 may be an example of one of plurality of meta-units 104. In this illustrative example, each other meta-unit of plurality of meta-units 104 is implemented in a manner similar to meta-unit 118. However, in other illustrative examples, one or more other meta-units in plurality of meta-units 104 may be implemented differently from meta-unit 118.

Each of plurality of meta-units 104 may include a metamaterial cell and a tunable element. In particular, the metamaterial cell provides a negative index of refraction for electromagnetic energy 110 that is within a particular frequency range. When electromagnetic energy 110 is not within the particular frequency range, electromagnetic energy 110 may be scattered by metamaterial structure 102. This type of scattering effect may be used to filter out undesired frequencies of electromagnetic energy 110 that propagates through the metamaterial structure 102.

The negative index of refraction provided by each meta-unit in plurality of meta-units 104 may produce an aggregate effect. This aggregate effect may also be referred to as an aggregate negative refractive index effect. The aggregate effect of the negative index of refraction provided by each meta-unit in plurality of meta-units 104 controls the shaping of electromagnetic energy 110 that propagates through metamaterial structure 102 such that electromagnetic energy 110 may be focused towards point 116 in space.

Each meta-unit in plurality of meta-units 104 may be tuned to adjust or vary the negative index of refraction response produced by the metamaterial cell of that meta-unit. Individual meta-units or groups of meta-units in plurality of meta-units 104 may be tuned to produce an aggregate effect that focuses electromagnetic energy 110 in the desired direction.

In one illustrative example, tuning a meta-unit, such as meta-unit 118, includes tuning a set of electromagnetic properties of the tunable element of meta-unit 118. The set of electromagnetic properties may include one or more electromagnetic properties. In one illustrative example, the set of electromagnetic properties may include electric permittivity, magnetic permeability, or both.

Tuning the electric permittivity, the magnetic permeability, or both of a tunable element of meta-unit 118 adjusts the resonance of the metamaterial cell of meta-unit 118. Changing the resonance of the metamaterial cell causes the frequency range at which a negative index of refraction is provided by meta-unit 118 to change.

Figure 2:
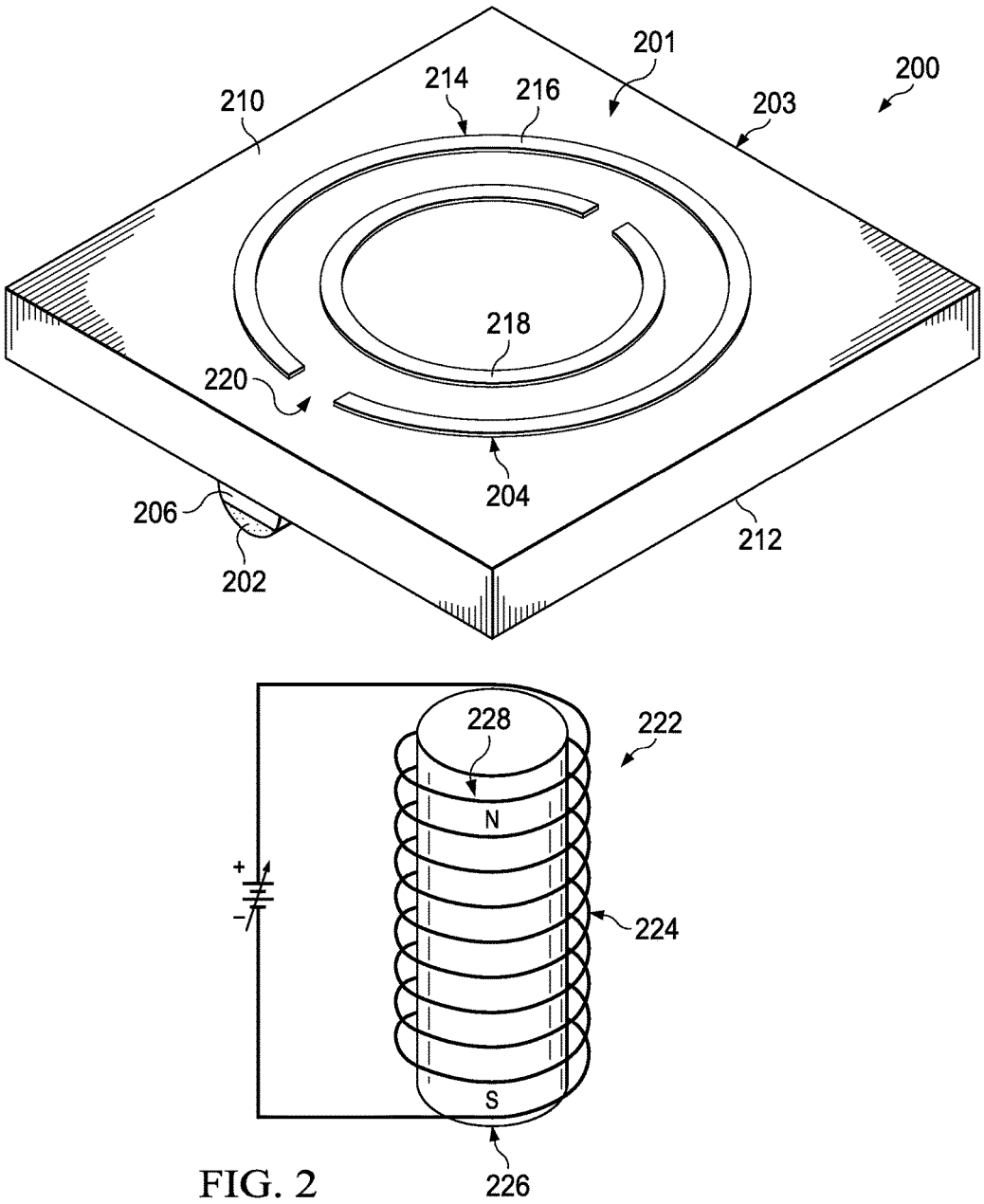
FIG. 2 is an illustration of a top isometric view of a meta-unit in accordance with an illustrative embodiment.

With reference now to FIG. 2, an illustration of a top isometric view of a meta-unit is depicted in accordance with an illustrative embodiment. In this illustrative example, meta-unit 200 may be an example of one implementation for any one of plurality of meta-units 104 in FIG. 1. In one illustrative example, meta-unit 200 may be an example of one manner in which meta-unit 118 in FIG. 1 may be implemented.

As depicted, meta-unit 200 includes metamaterial cell 201 and tunable element 202. Metamaterial cell 201 may include base 203, magnetic resonator 204, and conductive structure 206. Base 203, magnetic resonator 204, and conductive structure 206.

Base 203 may be comprised of any material or combination of materials that is transparent to an electromagnetic field having a natural frequency of metamaterial cell 201. In one illustrative example, base 203 takes the form of a dielectric substrate.

As depicted, magnetic resonator 204 and conductive structure 206 are disposed on side 210 and side 212, respectively, of base 203. Magnetic resonator 204 may be implemented in different ways. In one illustrative example, magnetic resonator 204 takes the form of dual split ring resonator 214. In other illustrative examples, magnetic resonator 204 may take the form of some other type of device that produces negative index of refraction for electromagnetic energy within a given frequency range. For example, without limitation, magnetic resonator 204 may take the form of a single split ring resonator, a Swiss roll capacitor, an array of metallic cylinders, a capacitive array of sheets wound on cylinders, some combination thereof, or some other type of device.

As depicted, when magnetic resonator 204 takes the form of dual split ring resonator 214, magnetic resonator 204 includes outer split ring 216 and inner split ring 218, which are concentric split rings. In other words, dual split ring resonator 214 has plurality of splits 220. Outer split ring 216 and inner split ring 218 may be etched or formed onto side 210 of base 203. Outer split ring 216 and inner split ring 218 affect or control the electromagnetic energy that propagates through meta-unit 200.

Conductive structure 206 is positioned relative to magnetic resonator 204. Conductive structure 206 may be electrically conductive. In this illustrative example, conductive structure 206 takes the form of an electrically conductive post or rod. In particular, conductive structure 206 may take the form of a metallic post. However, in other illustrative examples, conductive structure 206 may be implemented using a conductive piece of wire, a conductive plate, or some other type of electrically conductive element.

Tunable element 202 is associated with metamaterial cell 201. Tunable element 202 may be implemented in different ways such that tunable element 202 is associated with metamaterial cell 201 in different ways. In this illustrative example, tunable element 202 is associated with conductive structure 206.

As used herein, when one component is "associated" with another component, the two components are physically associated with each other. For example, a first component, such as tunable element 202, may be considered to be associated with a second component, such as conductive structure 206, by being at least one of secured to the second component, bonded to the second component, mounted to the second component, welded to the second component, fastened to the second component, disposed on the second component, deposited on the second component, or connected to the second component in some other suitable manner. The first component also may be associated with the second component indirectly using a third component. Further, the first component may be considered to be associated with the second component by being formed as part of the second component, as an extension of the second component, or both.

As used herein, the phrase "at least one of," when used with a list of items, means different combinations of one or more of the listed items may be used and only one of the items in the list may be needed. The item may be a particular object, thing, step, operation, process, or category. In other words, "at least one of" means any combination of items or number of items may be used from the list, but not all of the items in the list may be required.

For example, without limitation, "at least one of item A, item B, or item C" or "at least one of item A, item B, and item C" may mean item A; item A and item B; item B; item A, item B, and item C; or item B and item C. In some cases, "at least one of item A, item B, or item C" or "at least one of item A, item B, and item C" may mean, but is not limited to, two of item A, one of item B, and ten of item C; four of item B and seven of item C; or some other suitable combination.

In one illustrative example, tunable element 202 takes the form of a ferromagnetic material that is disposed on a portion of conductive structure 206. For example, without limitation, the ferromagnetic material may be disposed on at least one side of conductive structure 206.

In one illustrative example, the ferromagnetic material may be embedded within conductive structure 206 on the side of conductive structure 206 that is not facing base 203. In another illustrative example, ferromagnetic material may be deposited on conductive structure 206 using additive manufacturing processes to form tunable element 202. In some cases, tunable element 202 may take the form of one or more layers of ferromagnetic material that have been painted on the side of conductive structure 206 that is not facing base 203.

The magnetic permeability of tunable element 202 may be tuned to adjust the resonance of metamaterial cell 201. For example, tuning device 222 may be used to change the magnetic permeability of tunable element 202.

In this illustrative example, tuning device 222 includes magnetic device 224 having first end 226 and second end 228. In other illustrative examples, tuning device 222 may be implemented using more than one magnetic device.

Magnetic device 224 may be external to meta-unit 200 and may be used to apply a magnetic field to tunable element 202. Applying a magnetic field to tunable element 202 may affect the magnetic permeability of tunable element 202, which may, in turn, affect the resonance of metamaterial cell 201.

For example, without limitation, the magnitude or level of the magnetic field that is applied to tunable element 202 may be adjusted to thereby change the magnetic permeability of tunable element 202. Changing the magnetic permeability of tunable element 202 causes the resonance of metamaterial cell 201 to change, which in turn, changes the frequency range over which metamaterial cell 201 provides a negative index of refraction.

Figure 3:
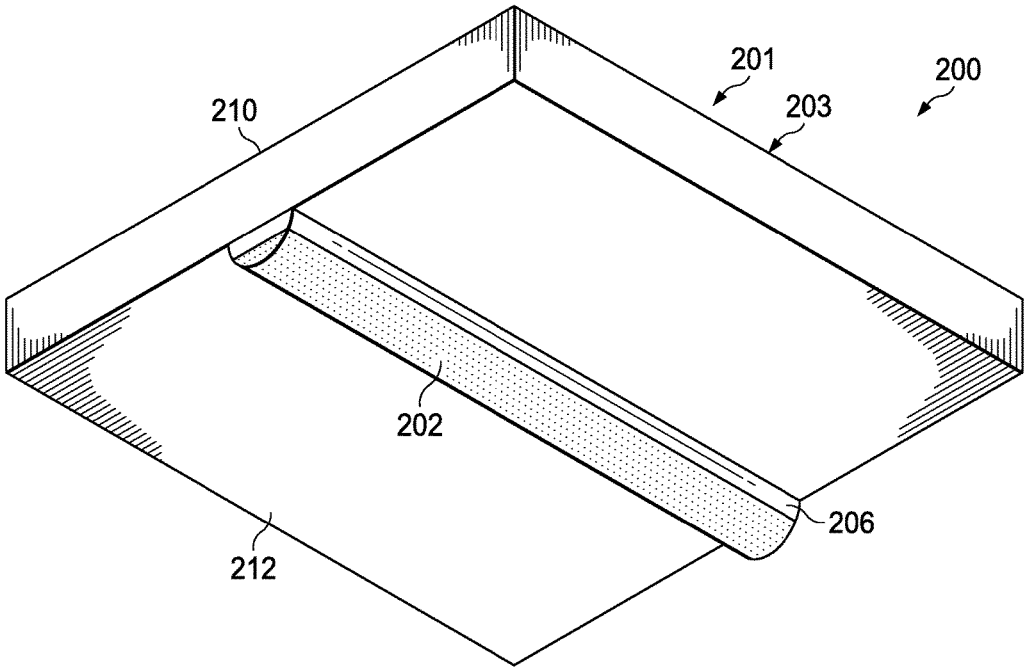
FIG. 3 is an illustration of a bottom isometric view of a meta-unit in accordance with an illustrative embodiment.

Turning now to FIG. 3, an illustration of a bottom isometric view of meta-unit 200 from FIG. 2 is depicted in accordance with an illustrative embodiment. In this illustrative example, side 212 of base 203 may be more clearly seen.

Figure 4:
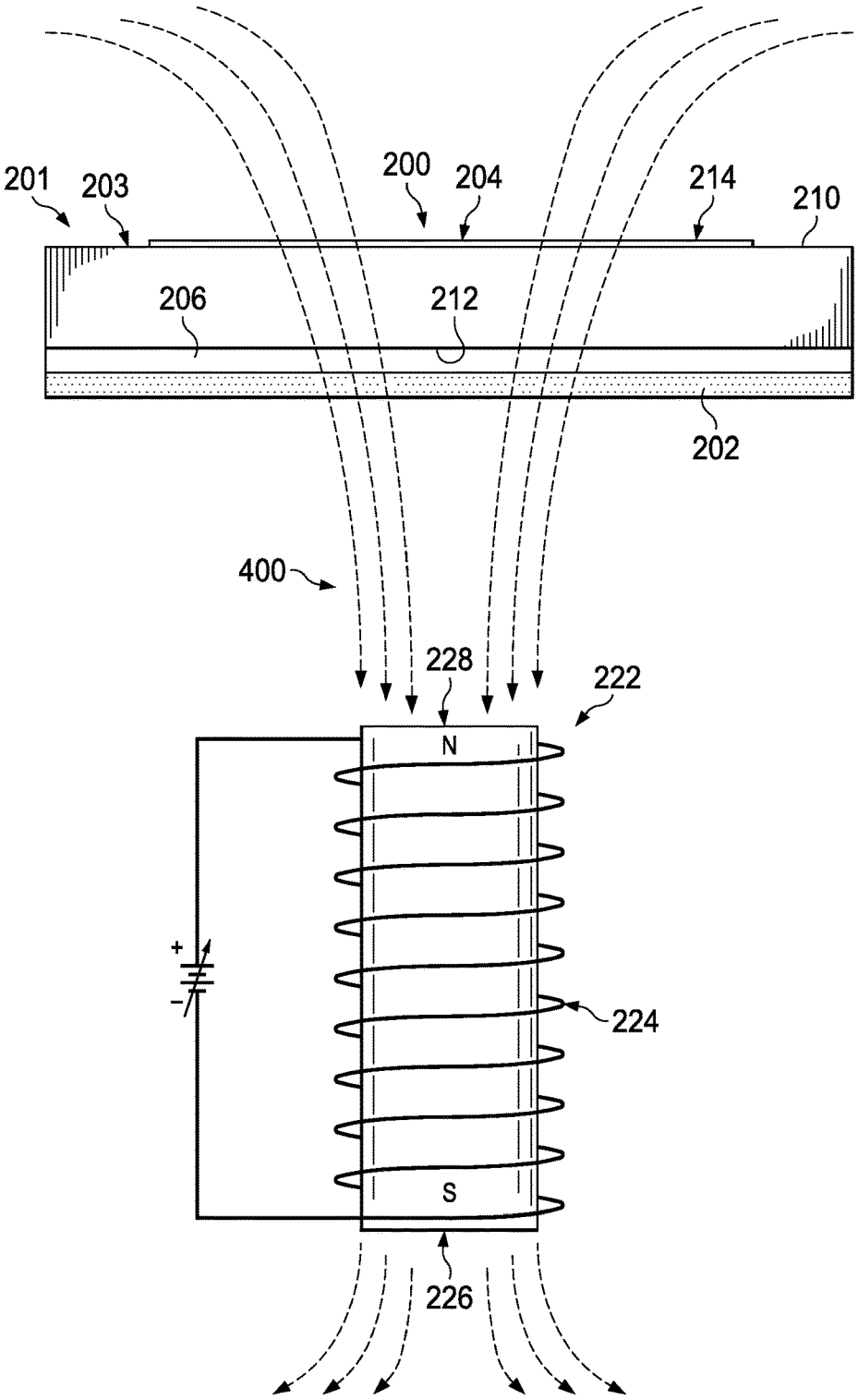
FIG. 4 is an illustration of a side view of a meta-unit and a tuning device in accordance with an illustrative embodiment.

With reference now to FIG. 4, an illustration of a side view of meta-unit 200 and tuning device 222 from FIG. 2-3 is depicted in accordance with an illustrative embodiment. In this illustrative example, tuning device 222 is used to apply magnetic field 400 to tunable element 202. Magnetic field 400 may be controlled by tuning device 222 to change the magnetic permeability of tunable element 202, thereby changing the resonance of metamaterial cell 201 of meta-unit 200.

As one illustrative example, as the magnitude of magnetic field 400 increases, the magnetic dipoles within tunable element 202 may align. This alignment may increase the effective magnetic flux through magnetic resonator 204 and shift the resonance of metamaterial cell 201 to thereby lower the frequencies of electromagnetic energy for which a negative index of refraction is provided.

Figure 5:
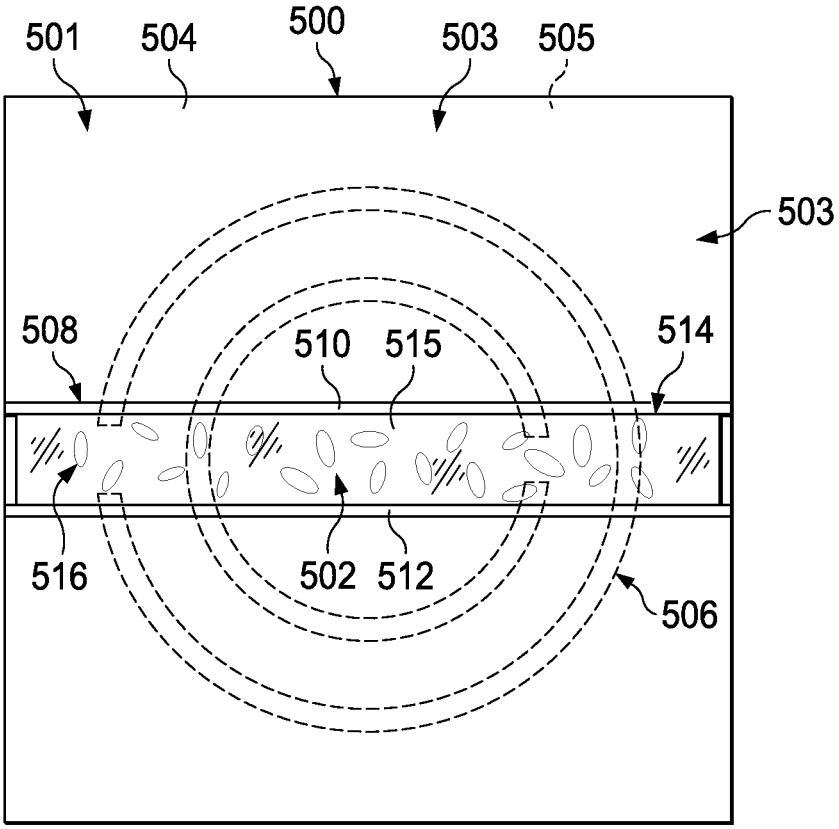
FIG. 5 is an illustration of a bottom view of another configuration for a meta-unit in accordance with an illustrative embodiment.

With reference now to FIG. 5, an illustration of a bottom view of another configuration for a meta-unit is depicted in accordance with an illustrative embodiment. In this illustrative example, meta-unit 500 may be another example of an implementation for at least one of plurality of meta-units 104 in FIG. 1. In particular, meta-unit 500 may be another example of one implementation for meta-unit 118 in FIG. 1.

As depicted, meta-unit 500 includes metamaterial cell 501 and tunable element 502. Metamaterial cell 501 may be implemented in a manner similar to metamaterial cell 201 in FIGS. 2-4.

As depicted, metamaterial cell 501 includes base 503 having first side 505 and second side 504. First side 505 is shown in phantom view in this illustrative example.

Metamaterial cell 501 further includes magnetic resonator 506, which is shown in phantom view and is disposed on first side 505. Metamaterial cell 501 also includes conductive structure 508. Conductive structure 508 is associated with second side 504 of base 503. In this illustrative example, conductive structure 508 may be implemented differently from conductive structure 206 in FIGS. 2-4.

In this illustrative example, conductive structure 508 comprises first conductor 510 and second conductor 512, both of which are electrically conductive. First conductor 510 and second conductor 512 take the form of a first electrode and a second electrode, respectively, which are disposed on second side 504 of base 503. In one illustrative example, first conductor 510 and second conductor 512 may be three-dimensionally printed on base 503.

Tunable element 502 is implemented differently in meta-unit 500 as compared to tunable element 202 in meta-unit 200 in FIGS. 2-4. In this illustrative example, tunable element 502 takes the form of a fluid mixture that is located between first conductor 510 and second conductor 512. In this illustrative example, the fluid mixture may be held in reservoir 514 formed between base 503, first conductor 510, second conductor 512, and cover 515. Cover 515 may take the form of a sheet of transparent plastic in this illustrative example.

In some illustrative examples, reservoir 514 may take the form of a channel or cavity that is formed within base 503 for holding the fluid mixture that forms tunable element 502. In some cases, the fluid mixture may be held in a plastic box, a box comprised of dielectric material, or some other type of structure disposed between first conductor 510 and second conductor 512.

In this illustrative example, the fluid mixture that forms tunable element 502 comprises plurality of liquid crystals 516. In this manner, reservoir 514 is filled with plurality of liquid crystals 516. Plurality of liquid crystals 516 may inherently have anisotropic geometry. In other words, each liquid crystal molecule of plurality of liquid crystals 516 may have a geometry that is directionally dependent. For example, without limitation, each liquid crystal of plurality of liquid crystals 516 may have a rod-type shape, a cigar-type shape, an oblate shape, or some other type of elongated shape.

Tuning the electric permittivity of plurality of liquid crystals 516 changes the resonance of metamaterial cell 501. The electric permittivity of plurality of liquid crystals 516 may be changed by applying an electric field to plurality of liquid crystals 516 using a tuning device (not shown). Applying an electric field to plurality of liquid crystals 516 may change an electric permittivity of plurality of liquid crystals 516, which may thereby change a resonance of metamaterial cell 501.

Figure 6:
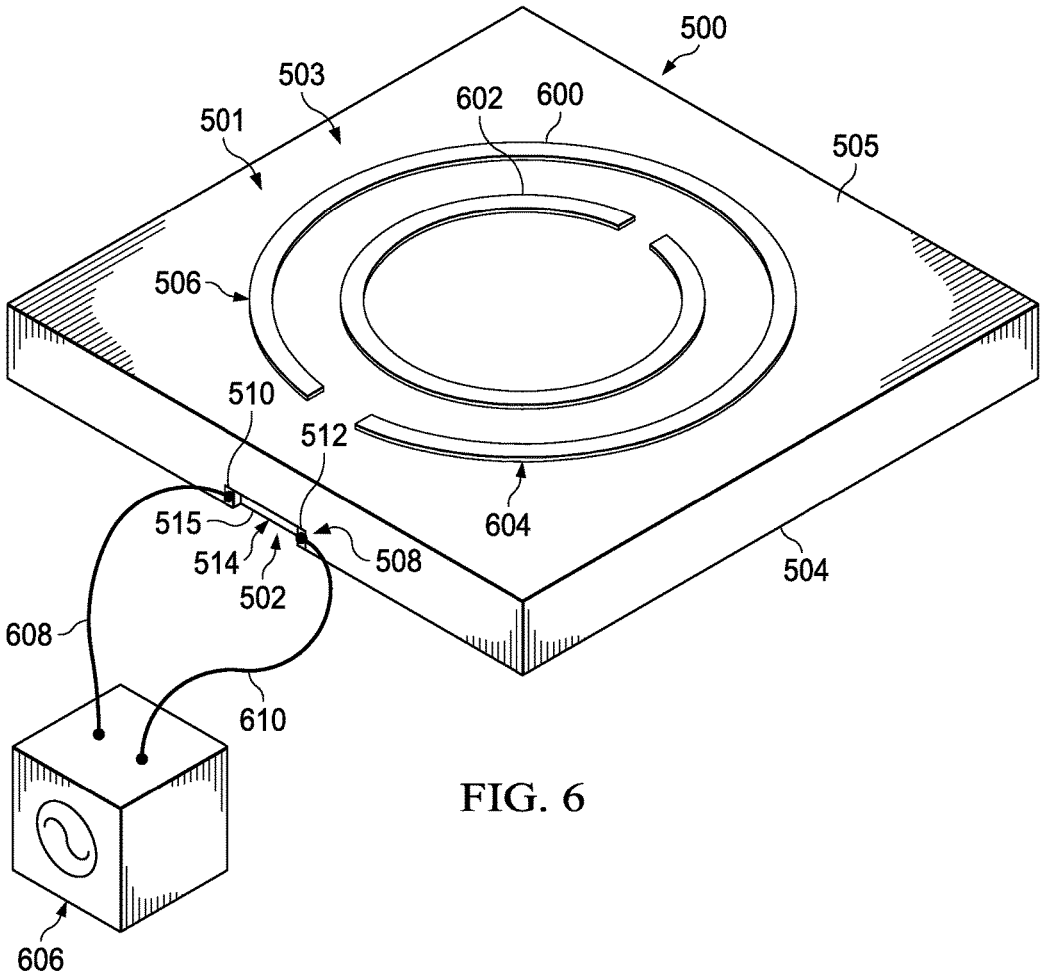
FIG. 6 is an illustration of a top isometric view of a meta-unit in accordance with an illustrative embodiment.

With reference now to FIG. 6, an illustration of a top isometric view of meta-unit 500 from FIG. 5 is depicted in accordance with an illustrative embodiment. In this illustrative example, first side 505 may be more clearly seen. As depicted, magnetic resonator 506 is disposed on first side 505 of base 503.

Magnetic resonator 506 includes outer split ring 600 and inner split ring 602, which are concentric. In this manner, magnetic resonator 506 takes the form of dual split ring resonator 604.

In this illustrative example, plurality of liquid crystals 516 that form tunable element 502 is held within reservoir 514 formed between base 503, first conductor 510, second conductor 512, and cover 515. First conductor 510, second conductor 512, and cover 515 may be substantially flush with second side 504 of base 503 in that first conductor 510, second conductor 512, and cover 515 do not protrude or extend past second side 504. In some cases, reservoir 514 may be considered to be formed as a channel within base 503.

Tuning device 606 may be used to apply an electric field to tunable element 502. In this illustrative example, tuning device 606 takes the form of an alternating current bias voltage source that can be controlled to generate voltage that can be varied. In other illustrative examples, tuning device 606 may take the form of some other type of controllable voltage source.

In this illustrative example, tuning device 606 is connected to first conductor 510 through line 608 and is connected to second conductor 512 through line 610. Tuning device 606 may be used to apply a voltage to first conductor 510 and to second conductor 512, which may create a potential difference between first conductor 510 and second conductor 512. This potential difference results in an electric field being applied to plurality of liquid crystals 516 that form tunable element 502. Changing the voltage applied to first conductor 510 and to second conductor 512 may change the magnitude or level of the electric field applied to plurality of liquid crystals 516.

Applying an electric field to plurality of liquid crystals 516 affects the electric permittivity of plurality of liquid crystals 516. Thus, changing the voltage applied to first conductor 510 and second conductor 512 changes the electric permittivity of plurality of liquid crystals 516, thereby changing the resonance of metamaterial cell 501.

Figure 7:
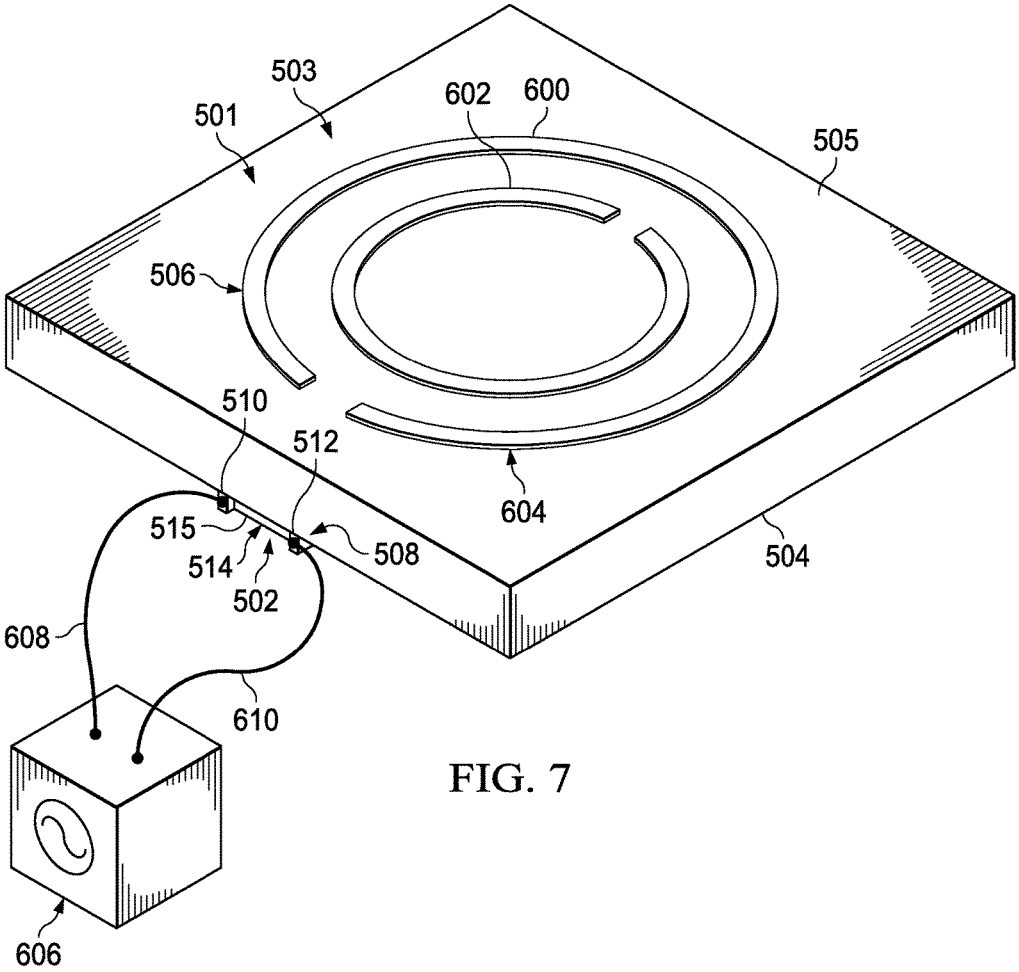
FIG. 7 is an illustration of a top isometric view of a meta-unit in accordance with an illustrative embodiment.

With reference now to FIG. 7, an illustration of a top isometric view of meta-unit 500 from FIGS. 5-6 having reservoir 514 that is located outside of base 503 is depicted in accordance with an illustrative embodiment. In this illustrative example, reservoir 514 is located at, and attached to, second side 504 of base 503. First conductor 510 and second conductor 512 protrude out past second side 504 of base 503.

Figure 8:
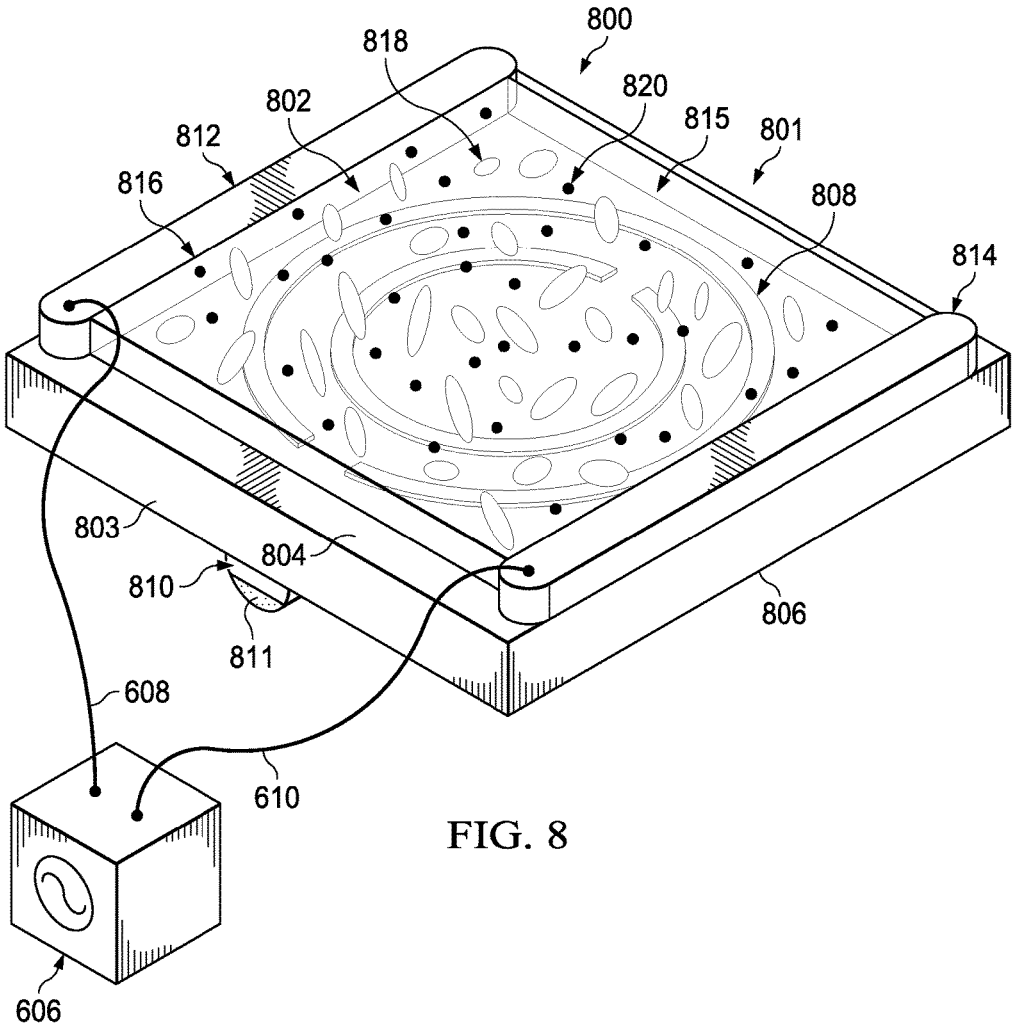
FIG. 8 is an illustration of a top view of a top isometric view of another configuration for a meta-unit in accordance with an illustrative embodiment.

With reference now to FIG. 8, an illustration of a top isometric view of another configuration for a meta-unit is depicted in accordance with an illustrative embodiment. In this illustrative example, meta-unit 800 may be another example of an implementation for at least one of plurality of meta-units 104 in FIG. 1, including, but not limited to, meta-unit 118 in FIG. 1.

As depicted, meta-unit 800 includes metamaterial cell 801 and tunable element 802. Metamaterial cell 801 may be implemented in a manner similar to metamaterial cell 201 in FIGS. 2-4 and metamaterial cell 501 in FIGS. 5-7.

Metamaterial cell 801 includes base 803 having first side 804 and second side 806. Metamaterial cell 801 further includes magnetic resonator 808. Magnetic resonator 808 may take the form of, for example, without limitation, a dual split ring resonator. Additionally, metamaterial cell 801 includes conductive structure 810. Conductive structure 810 comprises conductive post 811, first electrode 812, and second electrode 814.

Tunable element 802 takes the form of fluid mixture 815 in this illustrative example. Fluid mixture 815 is present between first electrode 812 and second electrode 814. Fluid mixture 815 is held within reservoir 816 formed between first electrode 812 and second electrode 814.

Fluid mixture 815 comprises plurality of liquid crystals 818 and plurality of magnetic nanoparticles 820. Plurality of magnetic nanoparticles 820 may be dispersed among plurality of liquid crystals 818.

Plurality of magnetic nanoparticles 820 belong to a class of nanoparticles that can be manipulated using magnetic field gradients. A magnetic nanoparticle of plurality of magnetic nanoparticles 820 may comprise at least one of iron, nickel, cobalt, some other type of magnetic element, or a chemical compound that includes at least one of iron, nickel, cobalt, a ferromagnetic material, or some other type of magnetic element. In some illustrative examples, nanoparticles may include a silica or polymer protective coating to protect against chemical or electrochemical corrosion.

In one illustrative example, plurality of magnetic nanoparticles 820 take the form of a plurality of ferromagnetic nanoparticles. These ferromagnetic nanoparticles may take the form of a plurality of nanoferrite particles. Further, such nanoparticles may comprise nanoferrite particles, barium ferrite particles, or other suitable ferrite materials.

An electric field may be applied to plurality of liquid crystals 818 to change an electric permittivity of plurality of liquid crystals 818. For example, without limitation, tuning device 606 from FIG. 6 may be used to apply a voltage to first electrode 812 through line 608 and second electrode 814 through line 610. Applying a voltage to first electrode 812 and second electrode 814 creates a potential difference between these electrodes and thereby, an electric field across fluid mixture 815. The voltage may be controlled and varied by tuning device 606. Changing the voltage applied to first electrode 812 and second electrode 814 changes the potential difference between these electrodes, which changes the magnitude of the electric field applied across fluid mixture 815, which thereby changes the electric permittivity of plurality of liquid crystals 818.

Additionally, applying the electric field to plurality of liquid crystals 818 causes a first alignment of plurality of liquid crystals 818 to change. The change in the first alignment of plurality of liquid crystals 818 may cause a corresponding change in a second alignment of plurality of magnetic nanoparticles 820. The change in the second alignment of plurality of magnetic nanoparticles 820 may change the magnetic permeability of plurality of magnetic nanoparticles 820.

The change in the electric permittivity of plurality of liquid crystals 818 and the change in magnetic permeability of plurality of magnetic nanoparticles 820 together cause a change in the resonance of metamaterial cell 801. In this manner, the resonance of metamaterial cell 801 may be custom-tuned.

In some cases, a ferromagnetic material (not shown) may be disposed on conductive post 811. An external magnetic device, such as magnetic device 224 in FIG. 2, may be used to apply a magnetic field to the ferromagnetic material that changes the magnetic permeability of the ferromagnetic material, which, in turn, changes the resonance of metamaterial cell 801. In some cases, the magnetic field may also affect the magnetic permeability of plurality of magnetic nanoparticles 820.

The ratio of plurality of magnetic nanoparticles 820 to plurality of liquid crystals 818 in fluid mixture 815 may be tuned. For example, the ratio of plurality of magnetic nanoparticles 820 to plurality of liquid crystals 818 may be selected such that fluid mixture 815 maintains a liquid viscosity and has a desired amount of flow. In one illustrative example, fluid mixture 815 may have a 1:1 ratio by weight of plurality of magnetic nanoparticles 820 to plurality of liquid crystals 818. In another illustrative example, fluid mixture 815 may have a ratio of plurality of magnetic nanoparticles 820 to plurality of liquid crystals 818 that is between 1:1 and 10:1.

As described in FIGS. 1-8, the resonance of a metamaterial cell may be changed in different ways by tuning the electric permittivity, magnetic permeability, or both of a tuning element that is associated with the metamaterial cell. The process of adaptively tuning the resonance of a metamaterial cell using a tunable element may be repeated for one or more meta-units in, for example, plurality of meta-units 104 in FIG. 1. In this manner, the aggregate effect produced by plurality of meta-units 104 in metamaterial structure 102 may be custom-tailored for a customized frequency range of electromagnetic energy 110.

The illustrations of energy directing system 100 in FIG. 1, meta-unit 200 in FIGS. 2-4, meta-unit 500 in FIGS. 5-7, and meta-unit 800 in FIG. 8 are not meant to imply physical or architectural limitations to the manner in which an illustrative embodiment may be implemented. Other components in addition to or in place of the ones illustrated may be used. Some components may be optional.

In some illustrative examples, conductive structure 810 in FIG. 8 may include conductive post 811 and a pair of conductive plates instead of first electrode 812 and second electrode 814. In some cases, meta-unit 800 may be implemented using some other type of magnetic resonator 808 other than a dual split ring resonator. In some illustrative examples, a tuning device may include both a magnetic device and a controllable voltage source.

Figure 9:
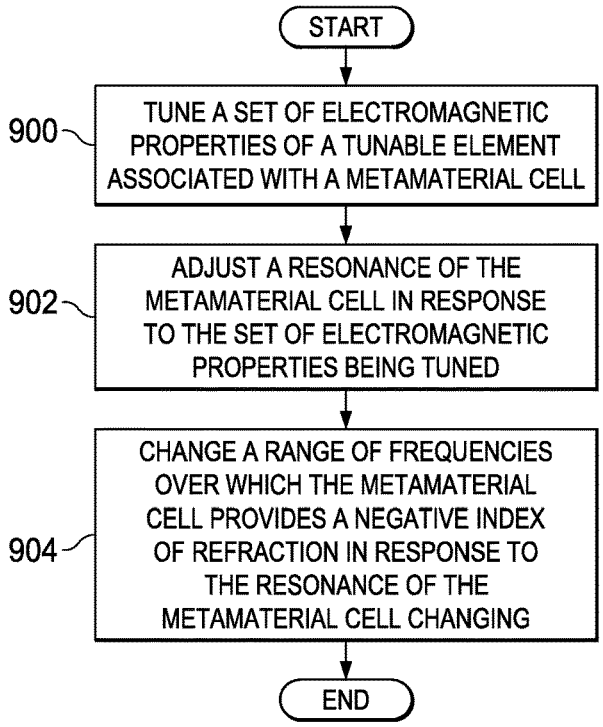
FIG. 9 is an illustration of a process for tuning a metamaterial cell in the form of a flowchart in accordance with an illustrative embodiment.

With reference now to FIG. 9, an illustration of a process for tuning a metamaterial cell is depicted in the form of a flowchart in accordance with an illustrative embodiment.

The process illustrated in FIG. 9 may be implemented to tune a resonance of a metamaterial cell in a meta-unit such as one of plurality of meta-units 104 in FIG. 1.

The process may begin by tuning a set of electromagnetic properties of a tunable element associated with the metamaterial cell (operation 900). A resonance of the metamaterial cell is adjusted in response to the set of electromagnetic properties being tuned (operation 902).

A range of frequencies over which the metamaterial cell provides a negative index of refraction is changed in response to the resonance of the metamaterial cell changing (operation 904), with the process terminating thereafter. In other words, the process described in FIG. 9 may be used to change the set of electromagnetic properties of a tunable element associated with a metamaterial cell to adjust a resonance of the metamaterial cell, and to thereby, adjust a frequency range over which the metamaterial cell yields a negative index of refraction.

Figure 10:
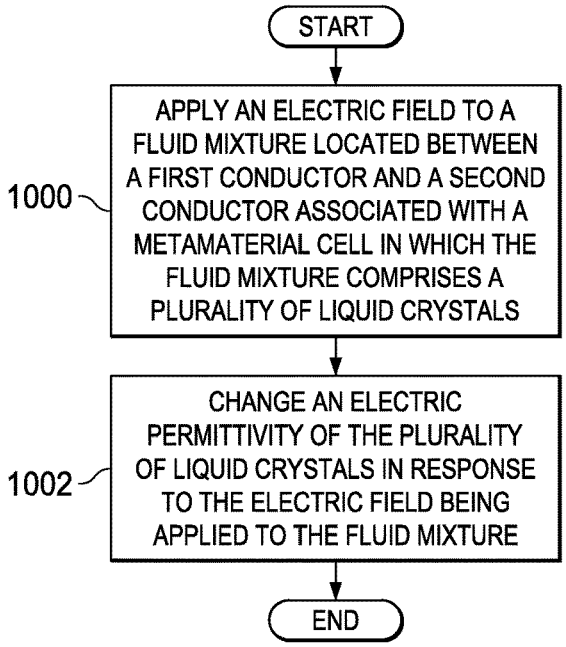
FIG. 10 is an illustration of a process for tuning a set of electromagnetic properties of a tunable element associated with a metamaterial cell in the form of a flowchart in accordance with an illustrative embodiment.

With reference now to FIG. 10, an illustration of a process for tuning a set of electromagnetic properties of a tunable element associated with a metamaterial cell is depicted in the form of a flowchart in accordance with an illustrative embodiment. The process illustrated in FIG. 10 may be used to implement operation 900 in FIG. 9.

The process may begin by applying an electric field to a fluid mixture located between a first conductor and a second conductor associated with a metamaterial cell in which the fluid mixture comprises a plurality of liquid crystals (operation 1000). Operation 1000 may be performed by, for example, applying a voltage to the first conductor and the second conductor to create a potential difference between the first conductor and the second conductor. Changing the voltage applied changes the potential difference created, which changes the electric field.

An electric permittivity of the plurality of liquid crystals is changed in response to the electric field being applied to the fluid mixture (operation 1002), with the process terminating thereafter. The extent to which the electric permittivity of the plurality of liquid crystals changes is determined by the level of the voltage applied to the first conductor and the second conductor. Thus, the electric permittivity of the plurality of liquid crystals may be finely tuned by controlling the voltage applied to the first conductor and the second conductor.

Figure 11:
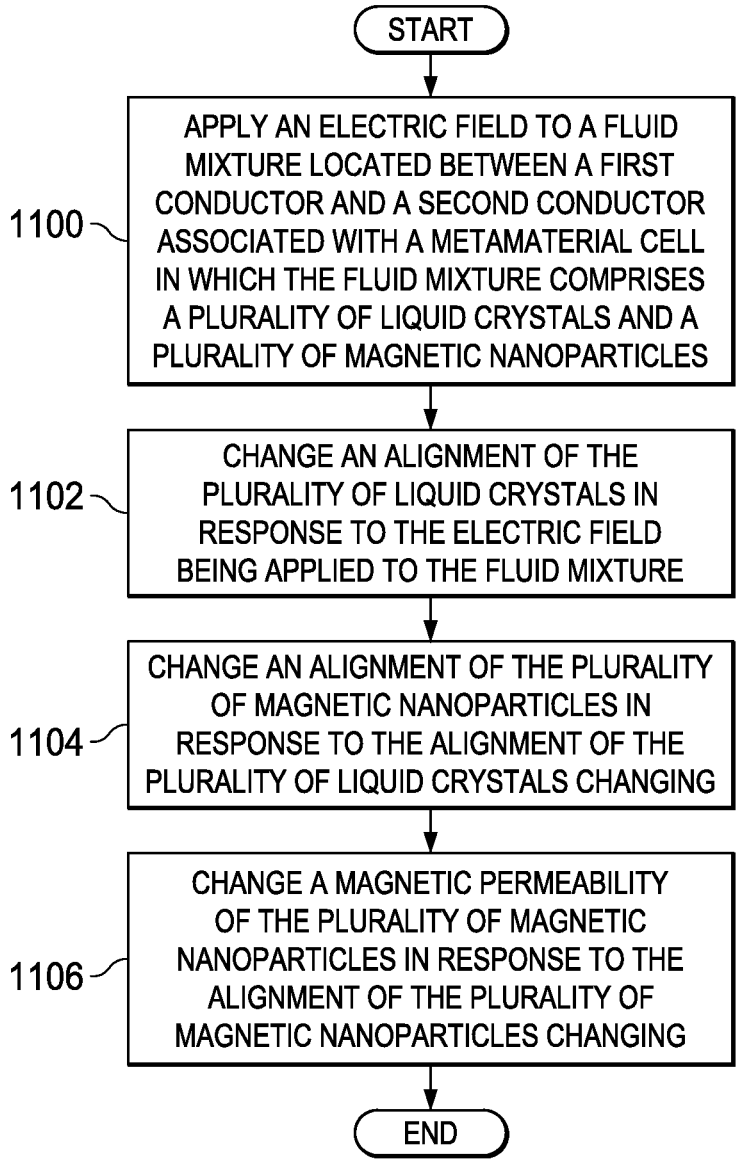
FIG. 11 is an illustration of a process for tuning a set of electromagnetic properties of a tunable element associated with a metamaterial cell in the form of a flowchart in accordance with an illustrative embodiment.

With reference now to FIG. 11, an illustration of a process for tuning a set of electromagnetic properties of a tunable element associated with a metamaterial cell is depicted in the form of a flowchart in accordance with an illustrative embodiment. The process illustrated in FIG. 11 may be used to implement operation 900 in FIG. 9.

The process may begin by applying an electric field to a fluid mixture located between a first conductor and a second conductor associated with a metamaterial cell in which the fluid mixture comprises a plurality of liquid crystals and a plurality of magnetic nanoparticles (operation 1100). Operation 1100 may be performed by, for example, applying a voltage to the first conductor and the second conductor, which creates a potential difference between the first conductor and the second conductor. Changing the voltage changes the potential difference, which changes the electric field.

An alignment of the plurality of liquid crystals is changed in response to the electric field being applied to the fluid mixture (operation 1102). An alignment of the plurality of magnetic nanoparticles is changed in response to the alignment of the plurality of liquid crystals changing (operation 1104). A magnetic permeability of the plurality of magnetic nanoparticles is changed in response to the alignment of the plurality of magnetic nanoparticles changing (operation 1106), with the process terminating thereafter.

Figure 12:
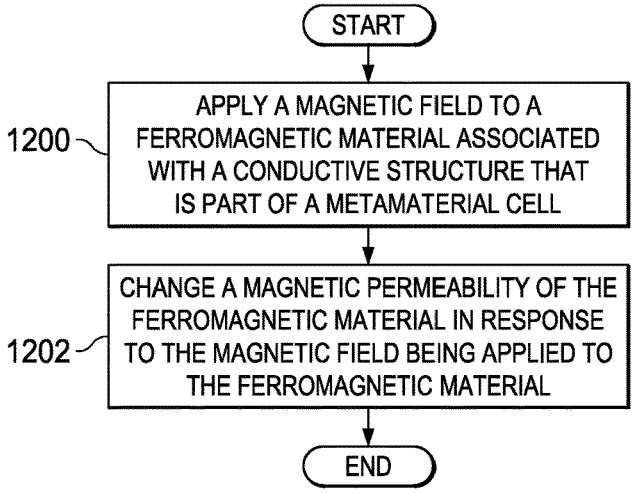
FIG. 12 is an illustration of a process for tuning a set of electromagnetic properties of a tunable element associated with a metamaterial cell in the form of a flowchart in accordance with an illustrative embodiment.

With reference now to FIG. 12, an illustration of a process for tuning a set of electromagnetic properties of a tunable element associated with a metamaterial cell is depicted in the form of a flowchart in accordance with an illustrative embodiment. The process illustrated in FIG. 12 may be used to implement operation 900 in FIG. 9.

The process may begin by applying a magnetic field to a ferromagnetic material associated with a conductive structure that is part of a metamaterial cell (operation 1200). Operation 1200 may be performed by, for example, using an external magnetic device to apply the magnetic field. A magnetic permeability of the ferromagnetic material is changed in response to the magnetic field being applied to the ferromagnetic material (operation 1202), with the process terminating thereafter.

Figure 13:
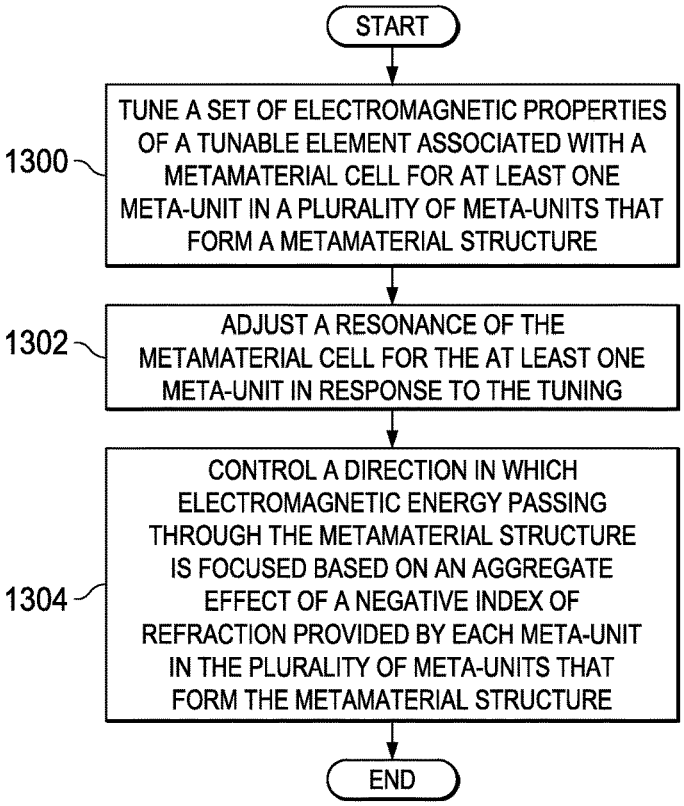
FIG. 13 is an illustration of a process for focusing electromagnetic energy in the form of a flowchart in accordance with an illustrative embodiment.

With reference now to FIG. 13, an illustration of a process for focusing electromagnetic energy is depicted in the form of a flowchart in accordance with an illustrative embodiment. The process illustrated in FIG. 13 may be implemented using metamaterial structure 102 in FIG. 1 to focus electromagnetic energy 110.

The process begins by tuning a set of electromagnetic properties of a tunable element associated with a metamaterial cell for at least one meta-unit in a plurality of meta-units that form a metamaterial structure (operation 1300). A resonance of the metamaterial cell is adjusted for the at least one meta-unit in response to the tuning (operation 1302).

A direction in which electromagnetic energy passing through the metamaterial structure is focused is controlled based on an aggregate effect of a negative index of refraction provided by each meta-unit in the plurality of meta-units that form the metamaterial structure (operation 1304), with the process terminating thereafter. In particular, the plurality of meta-units may be used to focus electromagnetic energy within a particular frequency range in a desired direction but to scatter electromagnetic energy outside of this particular frequency range.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

Thus, the illustrative embodiments provide a method and apparatus for tuning the resonance of metamaterial cells. In particular, the frequency response of a metamaterial cell may be tuned by externally applying a magnetic field, an electric field, or both to a tunable element associated with the metamaterial cell.

In one illustrative example, a metamaterial cell may be tuned using ferromagnetic material that has been uniquely deposited onto a conductive post or mixed into a fluid mixture to control the total magnetic flux through the metamaterial cell. In some cases, the ferromagnetic material may take the form of a plurality of magnetic nanoparticles that are mixed with a plurality of liquid crystals in the fluid mixture. In another illustrative example, a metamaterial cell may be tuned using a plurality of liquid crystals by controlling a total electric field applied to the plurality of liquid crystals and, in some cases, around a conductive post associated with the metamaterial cell.

Increasing at least one of the capacitance or inductance of the metamaterial cell is the mechanism used to alter the resonance frequency of the metamaterial cell. Increasing at least one of the capacitance or inductance results in a lowering of the metamaterial cell resonant frequency. The extent to which the capacitance and inductance can be changed may be limited by the size of and physical material properties of the metamaterial cell.

The illustrative embodiments described may be used to facilitate the cost effective fabrication of ferrite-enhanced metamaterials and the fabrication of high gain metamaterial-based antennas. Further, the overall bandwidth of a negative index metamaterial-based antenna may be increased. The illustrative embodiments provide a method for tuning a negative index metamaterial-based antenna that facilitates the focusing of electromagnetic signals and the filtering out of undesired electromagnetic signals at the negative index metamaterial-based antenna.

The illustrative embodiments provide a method and apparatus that may facilitate the cost-effective fabrication of wideband adaptive impedance matching and filtering networks. Further, the type of adjustable inductor described by the illustrative embodiments may improve overall performance of radio frequency (RF) systems and may reduce power consumption as compared to currently available inductors.

The adjustable inductor described by the illustrative embodiments may enable an impedance matching and filtering network to be made smaller and lighter. Further, this adjustable inductor may simplify the mechanical structures and assembly process needed for the impedance matching and filtering network by reducing the number of circuit components required.

The adjustable inductor and adjustable capacitor described by the illustrative embodiments may be particularly useful in forming circuit networks in various systems that operate at radio frequencies. These systems may include, but are not limited to, cellular phones, satellite communication systems, televisions, radar imaging systems, and other types of systems that operate at radio frequencies.

In one illustrative example, a ferrite-enhanced negative index metamaterial (FENIM) structure may be used to build a high-gain, lightweight lens antenna that directs radiofrequency energy in much the same manner as an optical lens does with respect to focusing light. The ferrite-enhanced negative index metamaterial may be tuned to have a wider range of frequencies for which a desired aggregative negative refractive index effect is produced.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a metamaterial cell that has a negative index of refraction; and a tunable element disposed on one side of the metamaterial cell, wherein tuning a set of electromagnetic properties of the tunable element adjusts a resonance of the metamaterial cell, wherein the metamaterial cell comprises: a magnetic resonator and a conductive structure positioned relative to the magnetic resonator; and wherein the magnetic resonator is a dual split ring resonator;

wherein the tunable element comprises a ferromagnetic material.

2. The apparatus of claim 1, wherein the metamaterial cell further comprises:

a base that is transparent to an electromagnetic field having a natural frequency of the metamaterial cell, wherein the magnetic resonator is disposed on the base.

3. The apparatus of claim 1 further comprising:

a tuning device that tunes the set of electromagnetic properties of the tunable element to adjust the resonance of the metamaterial cell.

4. The apparatus of claim 3, wherein the tuning device comprises:

a controllable voltage source that applies an electric field to the tunable element to tune an electric permittivity of the tunable element, thereby adjusting the resonance of the metamaterial cell.

5. The apparatus of claim 1, wherein the set of electromagnetic properties includes at least one of an electric permittivity or a magnetic permeability.

6. The apparatus of claim 1, wherein changing the set of electromagnetic properties of the tunable element adjusts the resonance of the metamaterial cell, to thereby adjust a frequency range over which the metamaterial cell yields the negative index of refraction.

7. The apparatus of claim 1, wherein the metamaterial cell and the tunable element form a meta-unit that is one of a plurality of meta-units that together form a metamaterial structure.

8. An apparatus comprising:

a metamaterial cell that has a negative index of refraction; and a tunable element disposed on one side of the metamaterial cell, wherein tuning a set of electromagnetic properties of the tunable element adjusts a resonance of the metamaterial cell;

wherein the metamaterial cell comprises: a magnetic resonator and a conductive structure positioned relative to the magnetic resonator;

wherein the conductive structure comprises: a first conductor and a second conductor;

wherein the tunable element comprises: a plurality of liquid crystals located within a reservoir between the first conductor and the second conductor.

9. The apparatus of claim 8 further comprising:

a tuning device that tunes the set of electromagnetic properties of the tunable element to adjust the resonance of the metamaterial cell.

10. The apparatus of claim 9, wherein the tuning device comprises:

a controllable voltage source that applies an electric field to the tunable element to tune an electric permittivity of the tunable element, thereby adjusting the resonance of the metamaterial cell.

11. The apparatus of claim 8, wherein the set of electromagnetic properties includes at least one of an electric permittivity or a magnetic permeability.

12. The apparatus of claim 8, wherein changing the set of electromagnetic properties of the tunable element adjusts the resonance of the metamaterial cell, to thereby adjust a frequency range over which the metamaterial cell yields the negative index of refraction.

13. The apparatus of claim 8, wherein the metamaterial cell and the tunable element form a meta-unit that is one of a plurality of meta-units that together form a metamaterial structure.

14. An apparatus comprising:

a metamaterial cell that has a negative index of refraction;

a tunable element disposed on one side of the metamaterial cell, wherein tuning a set of electromagnetic properties of the tunable element adjusts a resonance of the metamaterial cell; and a tuning device that tunes the set of electromagnetic properties of the tunable element to adjust the resonance of the metamaterial cell;

wherein the tuning device comprises: a magnetic device that externally applies a magnetic field to the metamaterial cell to tune a magnetic permeability of the tunable element, thereby adjusting the resonance of the metamaterial cell.

15. The apparatus of claim 14, wherein the set of electromagnetic properties includes at least one of an electric permittivity or a magnetic permeability.

16. The apparatus of claim 14, wherein changing the set of electromagnetic properties of the tunable element adjusts the resonance of the metamaterial cell, to thereby adjust a frequency range over which the metamaterial cell yields the negative index of refraction.

17. The apparatus of claim 14, wherein the metamaterial cell and the tunable element form a meta-unit that is one of a plurality of meta-units that together form a metamaterial structure.

18. An apparatus comprising:

a metamaterial cell that has a negative index of refraction; and a tunable element disposed on one side of the metamaterial cell, wherein tuning a set of electromagnetic properties of the tunable element adjusts a resonance of the metamaterial cell;

wherein the tunable element comprises: a fluid mixture comprising a plurality of liquid crystals and a plurality of magnetic nanoparticles, wherein tuning at least one of an electric permittivity of the plurality of liquid crystals or a magnetic permeability of the plurality of magnetic nanoparticles adjusts the resonance of the metamaterial cell.

19. A metamaterial structure comprising:

a plurality of meta-units, wherein a meta-unit in the plurality of meta-units comprises:

a metamaterial cell; and a tunable element disposed on one side of the metamaterial cell;

wherein tuning at least one of an electric permittivity or a magnetic permeability of the tunable element adjusts a resonance of the metamaterial cell; and wherein adjusting the resonance for at least a portion of the plurality of meta-units adjusts a frequency range over which the metamaterial structure provides a negative index of refraction for focusing electromagnetic energy;

wherein the metamaterial cell comprises: a magnetic resonator and a conductive structure positioned relative to the magnetic resonator;

wherein the magnetic resonator is a dual split ring resonator; and wherein the tunable element comprises a ferromagnetic material.

20. A method for tuning a metamaterial cell, the method comprising:

tuning a set of electromagnetic properties of a tunable element disposed on one side of the metamaterial cell;

adjusting a resonance of the metamaterial cell in response to the set of electromagnetic properties being tuned; and changing a range of frequencies over which the metamaterial cell provides a negative index of refraction in response to the resonance of the metamaterial cell changing;

wherein tuning the set of electromagnetic properties comprises: tuning an electric permittivity of a plurality of liquid crystals located within a reservoir disposed on the one side of the metamaterial cell to adjust the resonance of the metamaterial cell.

21. The method of claim 20 further comprising:

applying, externally, a magnetic field to the metamaterial cell to adjust the resonance of the metamaterial cell.

22. A method for tuning a metamaterial cell, the method comprising:

tuning a set of electromagnetic properties of a tunable element disposed on one side of the metamaterial cell;

adjusting a resonance of the metamaterial cell in response to the set of electromagnetic properties being tuned; and changing a range of frequencies over which the metamaterial cell provides a negative index of refraction in response to the resonance of the metamaterial cell changing;

wherein tuning the set of electromagnetic properties comprises: tuning a magnetic permeability of a plurality of magnetic nanoparticles located within a reservoir disposed on the one side of the metamaterial cell to adjust the resonance of the metamaterial cell.

23. The method of claim 22 further comprising:

applying, externally, a magnetic field to the metamaterial cell to adjust the resonance of the metamaterial cell.

24. A method for tuning a metamaterial cell, the method comprising:

tuning a set of electromagnetic properties of a tunable element disposed on one side of the metamaterial cell;

adjusting a resonance of the metamaterial cell in response to the set of electromagnetic properties being tuned; and changing a range of frequencies over which the metamaterial cell provides a negative index of refraction in response to the resonance of the metamaterial cell changing;

wherein tuning the set of electromagnetic properties comprises:

applying an electric field to a fluid mixture located in a reservoir disposed on the one side of the metamaterial cell, wherein the fluid mixture comprises a plurality of liquid crystals and a plurality of magnetic nanoparticles;

changing an alignment of the plurality of liquid crystals in response to the electric field being applied to the fluid mixture;

changing an alignment of the plurality of magnetic nanoparticles in response to the alignment of the plurality of liquid crystals changing; and changing a magnetic permeability of the plurality of magnetic nanoparticles in response to the alignment of the plurality of magnetic nanoparticles changing.

* * * * *